United States Patent [19]

Blum

[11] Patent Number: 5,073,080

[45] Date of Patent: Dec. 17, 1991

[54] GRAPPLE DEVICE FOR AUGER SECTIONS

[75] Inventor: Kenneth J. Blum, Parkville, Mo.

[73] Assignee: Berkel & Company, Bonner Springs, Kans.

[21] Appl. No.: 572,561

[22] Filed: Aug. 27, 1990

[51] Int. Cl.[5] ..... B66C 3/16

[52] U.S. Cl. ..... 414/739; 414/621; 414/735; 414/23

[58] Field of Search ..... 414/735, 739, 743, 23, 414/620, 621, 607

[56] References Cited

U.S. PATENT DOCUMENTS

| | | | |
|---|---|---|---|
| 2,802,585 | 8/1957 | Morin | 414/735 |
| 2,815,878 | 12/1957 | Vance | 414/620 |
| 3,071,405 | 1/1963 | Koehler | 414/23 X |
| 3,191,788 | 6/1965 | Hopfeld | 414/620 X |
| 3,198,366 | 8/1965 | Figershau et al. | 414/620 |
| 3,848,753 | 11/1974 | Borg et al. | 414/739 |
| 4,718,816 | 1/1988 | King | 414/739 |

*Primary Examiner*—Frank E. Werner
*Assistant Examiner*—William M. Hienz
*Attorney, Agent, or Firm*—Hovey, Williams Timmons & Collins

[57] ABSTRACT

A grapple device (12) adapted for coupling to a conventional loader (110) is provided which is especially adapted for the pickup and handling of elongated auger sections. The device (12) includes a pair of pivotal arms (28,30) having auger-engaging pickup members (72,74) secured to the outermost ends thereof. The arms (28,30) are movable between a closed, auger-engaging position and an open position by a stationary piston and cylinder assembly (94) equipped with an extensible piston rod (96); the rod (96) is coupled to the arms (28, 30) by pivotal links (104,106). Selective rotation of the arms (28, 30) is effected by motor (108) coupled via chain (112) and sprockets (110,88) to the arm assembly.

4 Claims, 3 Drawing Sheets

GRAPPLE DEVICE FOR AUGER SECTIONS

BACKGROUND OF THE INVENTION

1. Field of the Invention

The present invention is broadly concerned with a grapple device to facilitate the handling and use of elongated, heavy metallic auger sections typically employed in the production of grouted structural piles. More particularly, it is concerned with such a grapple device which is preferably designed for detachable connection to a conventional loader and which is capable of grasping, elevating and rotating an auger section so as to permit easy pickup and attachment of the section to an auger string. Advantageously, the grapple device is designed with pivotal grasping arms rotatable through a full 360° rotation with a relatively wide arc of travel for the pivot arms, so that sections of virtually any practical size and length may be readily handled.

2. Description of the Prior Art

In the formation of grouted structural piles, it is a common practice to provide an elongated, vertically oriented, powered auger having a hollow central shaft. This auger is lowered into the earth and rotated, thereby creating an upright hole in the earth. As the auger is withdrawn, flowable grout is delivered through the hollow central auger shaft, so as to fill the hole and form a structural pile.

In most instances, the elongated pile-forming auger is formed in sections each being several feet long. These sections are interconnected end to end to form a complete auger of desired length. The handling of these auger sections has proved to be a difficult undertaking, particularly under field conditions. That is, most such auger sections are presently handled manually, requiring several laborers to lift and position the auger section during interconnection and disconnection of the section from a string. Given that auger sections of this type typically weight 300–500 pounds, it will be appreciated that manual handling is both a difficult and dangerous task. Indeed, injuries resulting from dropping or mishandling of such heavy auger sections are not uncommon.

Accordingly, there is a real and unsatisfied need in the art for a mechanical device especially adapted for the safe, efficient pickup and handling of auger sections. At the same time, such a device must be cabpable of orienting the section at virtually any desired position in order to properly accomplish the desired end.

SUMMARY OF THE INVENTION

The present invention overcomes the problems outlined above and provides an apparatus for the handling of elongated auger sections or the like. Broadly speaking, the apparatus of the invention includes a pair of elongated grapple arms each equipped with an auger section-engaging member adjacent the outer member thereof. These arms are mounted both for selective pivotal movement thereof about respective pivot axes, and also for selective rotational movement thereof. Pivotal movement of the arms occurs through an arc of travel between an open position and a closed, auger section-engaging position. On the other hand, rotational movement is preferably through a full 360° , and is about a rotational axis which is transverse to the pivot axes of the grapple arms. Finally, motive means is provided for effecting the desired selective pivotal and rotational movement of the arms.

In preferred forms, the apparatus is hydrualically operated, i.e., a piston and cylinder assembly is provided for selective pivotal movement of the arms, whereas a hydraulic motor and chain and sprocket drive permit rotational movement of the arms. The overall apparatus further includes a rigid frame assembly, which is adapted for releasable connection with a conventional loader such as a "Bobcat" or a Case "Uni-Loader".

DESCRIPTION OF THE PREFERRED EMBODIMENT

Figure 1:
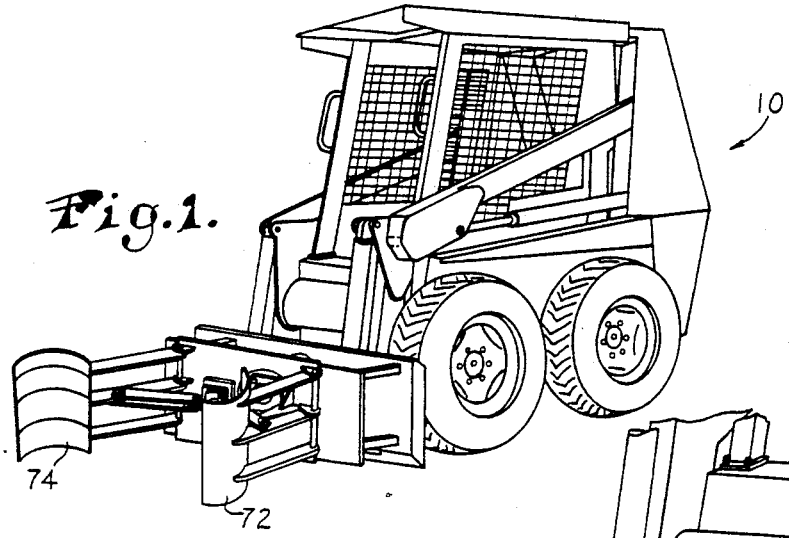
FIG. 1 is a perspective view of the auger grapple device of the invention operatively attached to the front of a Case Model 1840 Uni-Loader.
Figure 2:
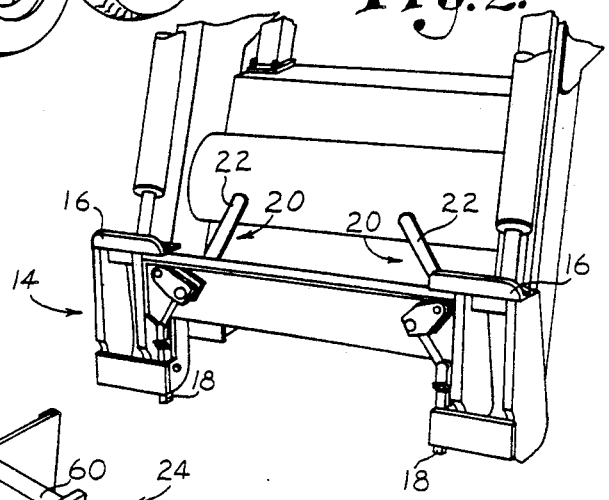
FIG. 2 is a fragmentary perspective view illustrating the front implement attachment structure forming a part of the Uni-Loader.
Figure 3:
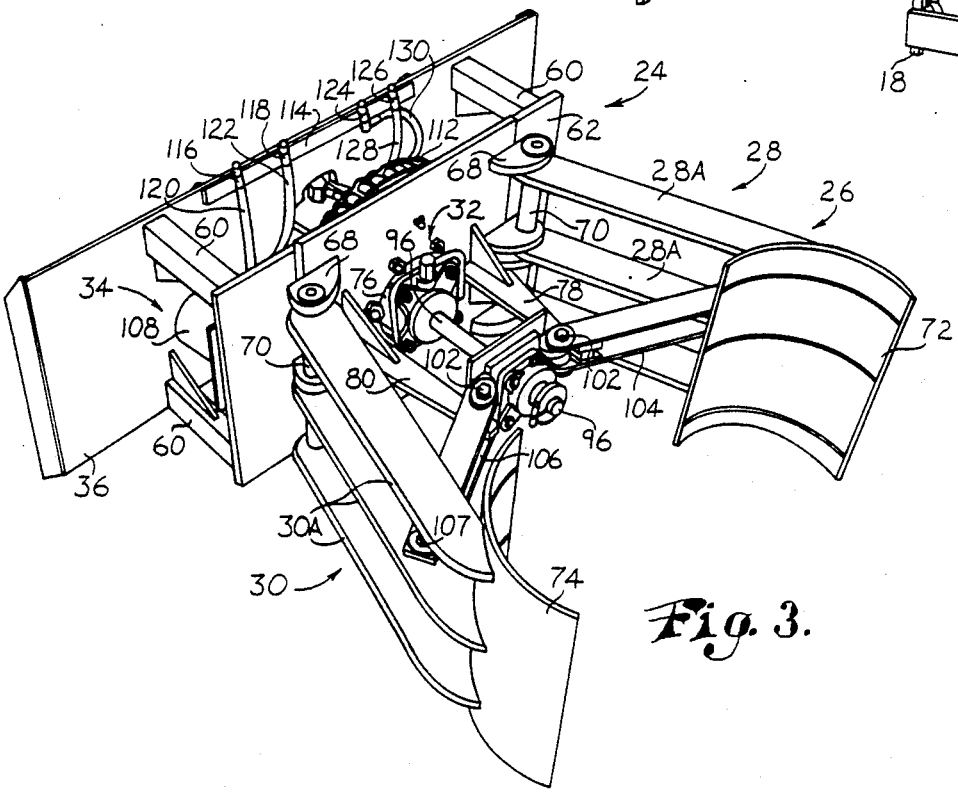
FIG. 3 is a perspective view of the grapple device of the invention.

Turning now to the drawings, it will be observed that FIG. 1 illustrates a conventional Case Model 1840 Uni-Loader 10 having a grapple device 12 in accordance with the invention secured to the front end of the loader 10. The loader 10 is entirely conventional and includes, adjacent the front thereof, an implement attachment assembly 14 having a pair of spaced apart, somewhat L-shaped mounts 16 as well as a pair of vertically oriented locking bars 18. Each locking bar 18 is operated by means of a lever assembly 20 so that, upon manipulation of the lever 22 associated with each assembly 20, the associated bar 18 is moved vertically either upwardly or downwardly.

Grapple device 12 broadly includes a rigid frame assembly 24, a grapple assembly 26 having a pair of pivot arms 28, 30, motive means 32 for effecting pivotal movement of the arms 28, 30, and motor assembly 34 for selective rotation of the arms 28, 30.

Figure 4:
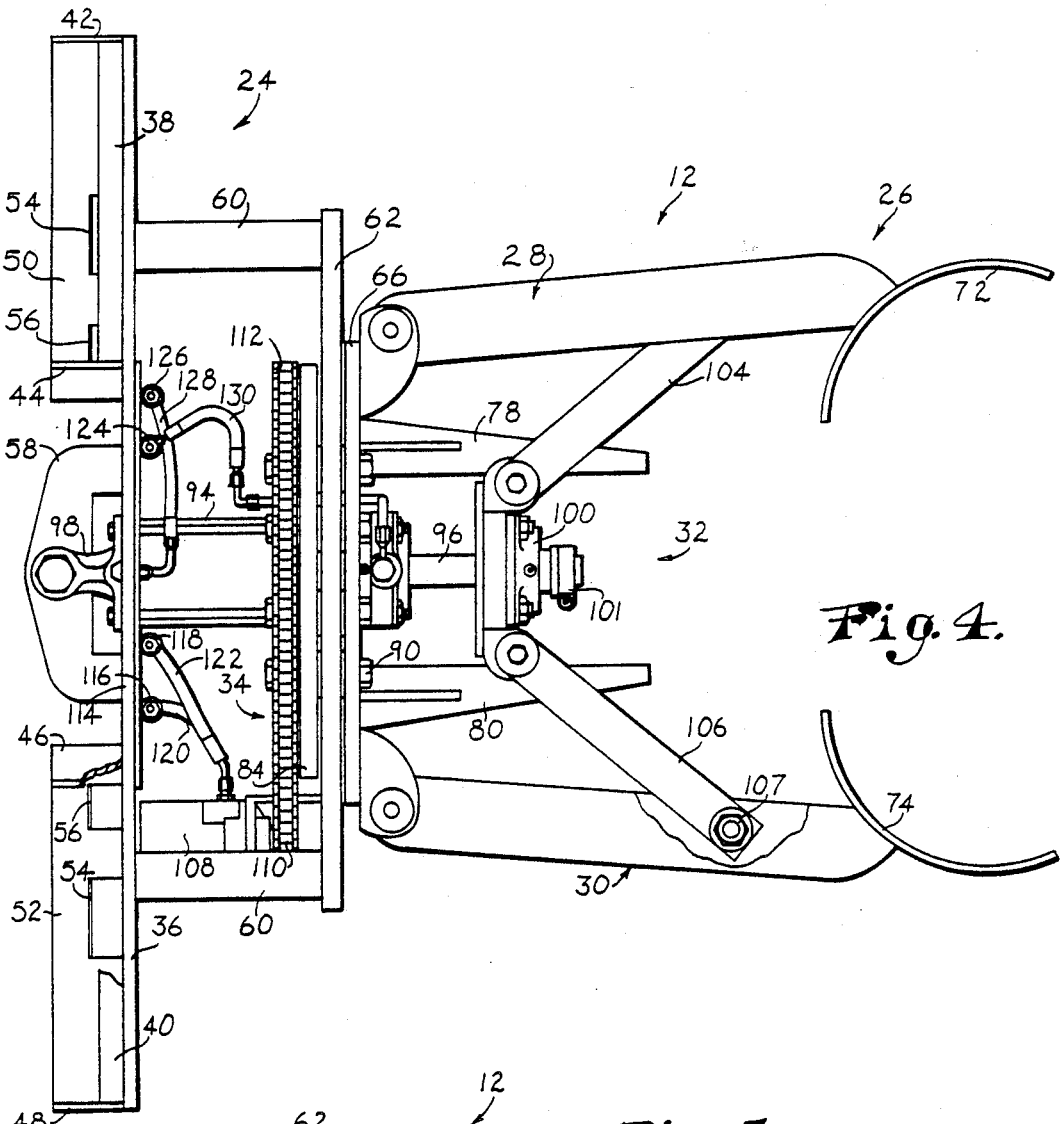
FIG. 4 is a plan view of the grapple device, with certain parts being broken away for clarity.

Frame assembly 24 includes an elongated, transversely extending rear most plate 36 presenting a pair of uppermost, obliquely oriented connectors 38, 40 adjacent the opposed ends thereof, together with rearwardly extending, spaced apart flanges 42, 44 and 46, 48 respectively on opposite sides of each connector 38, 40. Finally, a rearwardly and downwardly extending bottom wall 50, 52 is situated beneath a corresponding connector 38, 40; each of the bottom walls 50, 52 is provided with a pair of spaced apertures 54, 56 therein (see FIG. 4). The plate 36 also has a central opening 56 therethrough and a rearwardly extending, somewhat U-shaped, apertured bracket 58 which is important for purposes to be described.

Figure 5:
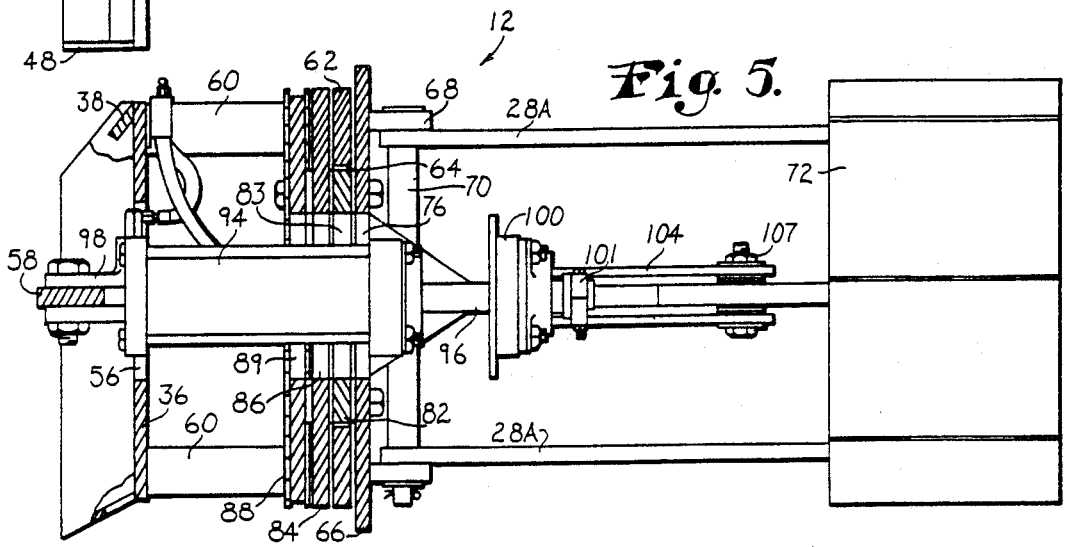
FIG. 5 is a side view, partially in section and with certain parts broken away, of the grapple device.
Figure 6:
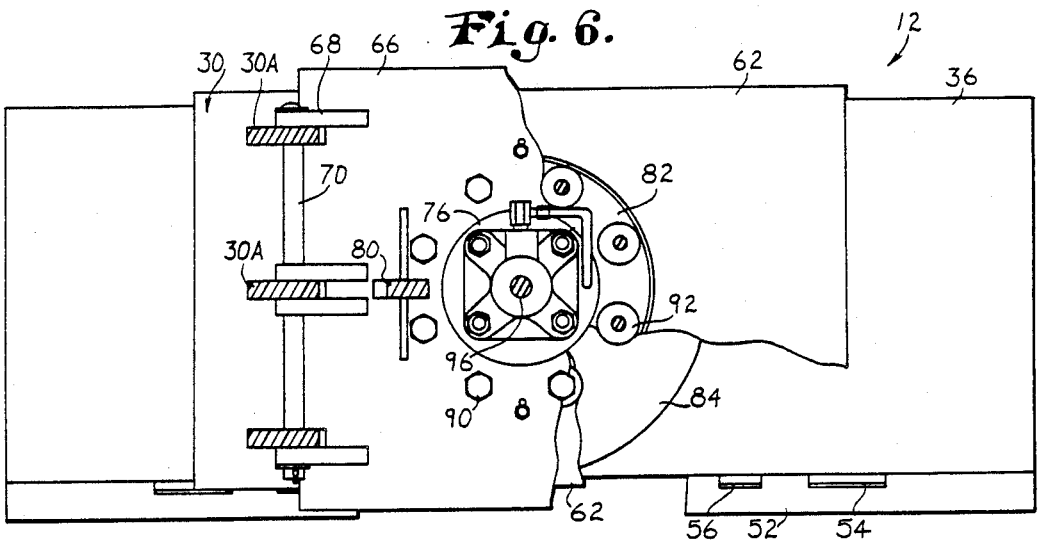
FIG. 6 is a fragmentary front view of the device, partially in section and with parts broken away.
Figure 7:
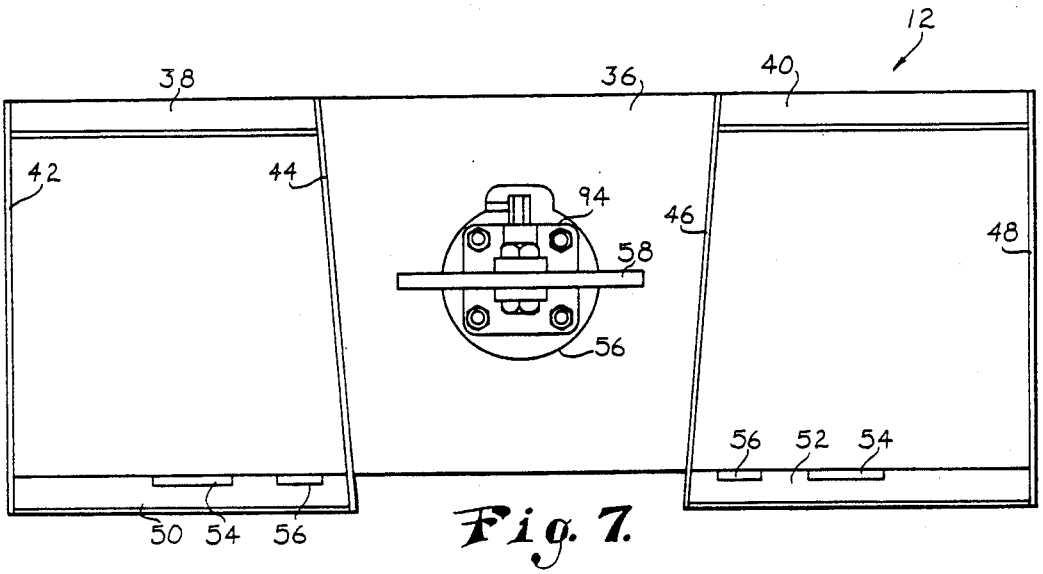
FIG. 7 is a rear elevational view of the grapple device.

A total of four rigid struts 60 are secured to and extend forwardly from plate 36. A forward frame plate 62 is secured to the outer end of the struts 60 and has a large central opening 64 therethrough (see FIG. 5.)

The grapple assembly 26 includes a forwardmost rotatable mounting plate 66 which is located in face-to-face adjacency with stationary plate 62. The arms 28, 30, each made up of three vertically spaced members 28*a* and 30*a*, are pivotally secured to the outer face of plate 66 by means of conventional hinge structure 68 including vertical hinge pins 70. The outer ends of the arms 28, 30 are equipped with corresponding, upright metallic, arcuate in cross-section grapple members 72, 74 design to cooperatively engage and handle an auger section (not shown). The plate 66 is also provided with a central opening 76, as well as a pair of forwardly extending metallic guides 78, 80 situated on opposite sides of the opening 76.

Grapple assembly 26 further has a annular secondary plate 82 disposed immediately behind plate 66 and positioned within opening 64 provided in rigid frame plate 62; a central aperture 83 is provided through the plate 82 as shown. A rearward, circular plate 84 is positioned adjacent the rearward plate 62, and has a central opening 86 therein. A rearmost sprocket wheel 88 having a central opening 89 is located adjacent circular plate 84. The plates 66, 82, and 84, and sprocket 88, are provided with aligned apertures, in order to permit interconnection of the rotatable plates 66, 82, and 84, as well as sprocket 88. To this end, connecting bolts 90 and intermediate washers 92 are employed for joining the aforementioned rotatable components for movement in unison relative to stationary frame plate 62.

Motive means 32 is designed to permit selective pivoting of arms 28, 30. For this purpose, a stationary piston and cylinder assembly 94 is provided, which is located within and extending through the openings 89, 86, 83 and 76. The assembly 94 is conventional and includes an extensible piston rod 96 as well as rearwardly extending connection clevis 98. A fixture plate 100 is secured to rod 96 adjacent its most outermost end, and supports a pair of hinge assemblies 102. Fixture 100 is of course rotatable relative to rod 96 to permit rotation of the arms 28, 30. A locking ring 101 is affixed to the outermost end of rod 96. A bifurcated link 104, 106 is secured to each hinge assembly 102 as shown, with the vertically spaced link members being situated on opposite sides of a corresponding guide 78 or 80. The outer ends of the links 104, 106 are respectively pivotally coupled with a central arm-defining member 28*a* or 30*a* by means of bolt assemblies 107. The rearward end of assembly 94 passes through aperture 56 of frame plate 36, with the clevis 98 being affixed to bracket 58.

Motor assembly 34 includes a hydraulic motor 108 affixedly secured to rigid frame plate 62 and having an output sprocket 110. A drive chain 112 is trained about the sprocket 110 and sprocket wheel 88, so that rotation of output sprocket 110 effects corresponding rotation sprocket 88 and thus the arms 28, 30.

In order to provide the necessary hydraulic fluid for actuation of the piston and cylinder assembly 94 and motor 108, a manifold bar 114 is affixed to the upper forward face of frame plate 36. A pair of quick-connect couplers 116, 118 are secured to bar 114, with appropriate hydraulic lines 120, 122 leading from the connectors to the inputs for motor 108 (see FIG. 4). Similarly, an additional pair of couplers 124, 126 are mounted to bar 114 and have hydrualic lines 128, 130 leading from those couplers to the opposite ends of the cylinder forming a part of assembly 94. Those skilled in the art will readily appreciate that hydraulic lines from the loader 10 can be connected to the couplers 116, 118 and 124, 126 in order to selectively actuate assembly 94 and motor 108.

In use, device 12 is first mounted onto loader 10. This is accomplished by driving the loader forwardly until the mounts 16 thereof fit beneath the respective connector plates 36, 38. At this point, the levers 22 are manipulated so as to lower the bars 18 into and through the openings 56 provided in bottom plates 50, 52. The larger openings 54 in such plates are provided for use with different types of loaders. After mounting, the entire device 12 may be bodily lifted by the loader, in the well known fashion.

When it is desired to use device 12 for picking up and handling of an auger section, the loader 10 is driven to the location of the section and the conventional hydraulic controls of the loader are manipulated to pivot the arms 28, 30 and/or rotate the latter. In particular, it will be seen that extension of piston rod 96 has the effect of opening the arms, whereas retraction of the rod effects closing movement of the arms, thereby permitting grasping of an auger section. When the section is properly engaged, the entire device 12 may be elevated, and thereupon the arms rotated through a full 360° arc of travel, if desired. The latter is accomplished by appropriate activation of motor 108 which causes powered movement of chain 112 and consequent rotation of sprocket wheel 88. Inasmuch as the wheel 88 is secured via plates 84, 82 and 66 to the arms 28, 30, it would be appreciated that sprocket rotation effects similar rotation of the arms 28, 30.

It will thus be appreciated that device 12 can be used to pick up and manipulate a heavy auger section and orient the section to virtually practical position required for efficient operations in the field. The dual capability afforded by the pivot arms 28, 30 and the rotation of such arms through a full 360° path of travel gives the device 12 exceptional operational flexibility.

I claim:

1. Apparatus for handling elongated articles, comprising:

a stationary frame presenting a rear plate, an apertured front plate in spaced, opposed relationship to the rear plate, and structure on said rear plate for releasably coupling the article handling apparatus to a mobile vehicle;

a rotatable, apertured plate located in close adjacency with the face of said front plate remote from said rear plate, with the aperture of the rotatable plate being in registry with the aperture of the front plate;

a pair of spaced apart arms each having an article-gripping member adjacent the outer end thereof;

means mounting the inner ends of said arms to said rotatable plate for pivotal movement thereof about respective pivot axes;

means for selectively pivoting said arms, including— a piston and cylinder assembly comprising an elongated cylinder presenting a rearward end and a forward end, and a reciprocal piston rod extending out of the forward end of the cylinder, means mounting said cylinder within said frame with the rearward cylinder end operatively secured to said frame rear plate, and with the cylinder extending forwardly and at least partially through the registered apertures of the front and rotatable plates, said rod extending outwardly beyond said front and rotatable plates and towards said arms, linkage means operably coupling said rod with said arms for pivotal movement of the arms in response to reciprocation of the rod; and means operably connected with said rotatable plate for the selective rotational movement of the rotatable plate and said arms about an axis essentially coincident with the longitudinal axis of said rod and transverse to the pivot axis of said arms.

2. Apparatus as set forth in claim 1, including an inboard apertured plate located in close adjacency with the face of said front plate proximal to said rear plate, the aperture of said inboard plate begin in registry with the apertures of said front and rotatable plates, there being means interconnecting said inboard and rotational plates for rotation thereof in unison, said cylinder extending at least partially through said registered apertures.

3. Apparatus as set forth in claim 1, said means for rotational movement of the plate and arms including motive means secured within said frame between said front and rear plates.

4. Apparatus as set forth in claim 1, said linkage means comprising two pairs of spaced apart pivotal links, said rotatable plate having a pair of elongated, forwardly extending guides secured thereto, each of said guides being oriented to pass between a corresponding one of said pivot link pairs during pivoting of said arms, whereby to guide the arms.

* * * * *